US005617803A

United States Patent [19]

Badillo

[11] Patent Number: 5,617,803

[45] Date of Patent: Apr. 8, 1997

[54] ROTARY LOOP TAKER WITH REPLACEABLE TIP

[75] Inventor: Paul Badillo, Littleton, Colo.

[73] Assignee: Bakron Corp., Buffalo Grove, Ill.

[21] Appl. No.: 429,698

[22] Filed: Apr. 27, 1995

[51] Int. Cl.[6] ..... D05B 57/14

[52] U.S. Cl. ..... 112/230

[58] Field of Search ..... 112/184, 228, 112/230, 231, 181

[56] References Cited

U.S. PATENT DOCUMENTS

| | | | |
|---|---|---|---|
| 1,431,380 | 10/1922 | Dickson | 112/228 |
| 3,139,050 | 6/1964 | Grabowski | 112/38 |
| 3,921,553 | 11/1975 | Gustmann et al. | 112/228 |
| 4,493,278 | 1/1985 | Badillo | 112/184 |
| 4,601,250 | 7/1986 | Clement | 112/184 |
| 4,966,088 | 10/1990 | Badillo | 112/184 |
| 5,427,042 | 6/1995 | Yamasaki | 112/230 |
| 5,474,004 | 12/1995 | Badillo | 112/230 |

*Primary Examiner*—Ismael Izaguirre

*Attorney, Agent, or Firm*—Wood, Phillips, VanSanten, Clark & Mortimer

[57] ABSTRACT

A rotary loop taker is provided having a frame with a rotational axis and including an annular part and a support extending radially from the rotational axis to the annular frame part. A loop seizing point is removably maintained in an operative position on the frame through a fixed projection on one of the loop seizing point and annular part of the frame, a first receptacle for the first projection on the other of the loop seizing point and annular part of the frame, a second fixed projection on one of the loop seizing point and annular part of the frame, and a second receptacle for the second projection on one of the loop seizing point and annular part of the frame.

23 Claims, 4 Drawing Sheets

ROTARY LOOP TAKER WITH REPLACEABLE TIP

BACKGROUND OF THE INVENTION

1. Field of the Invention

The invention relates to a rotary loop taker and, more specifically, to a rotary loop taker with a replaceable portion carrying upon it a portion of a raceway and a loop seizing tip. The replaceable portion must be stabilized in order to endure the severe impact of needle deflection. The present invention provides a means to stabilize the replaceable portion.

2. Background Art

A rotary loop taker is a device that must be incorporated into all lock stitch sewing machines. Perhaps 60% of the worldwide stock of sewing machines is of the lock stitch type. The rotary loop taker of the conventional type is precision machined to tight tolerances and is highly polished. These parts are costly items that often are short lived in today's industrial sewing environment.

The concept of using a replaceable tip rotary loop taker involves isolating the short-lived wear portions of the loop taker from the whole and making those portions removable, thereby saving that portion that is still undamaged and functional.

Much of the prior art relating to replaceable tip hooks shows rotary hooks having a vertically laminated construction. Rotary loop takers of this type unavoidably show cracks in which the thread can get caught. In addition, vertically laminated rotary loop takers are inherently relatively weak because they are not of a solid mass. Despite the disadvantages, the approach of vertical lamination has been followed at least since Dickson, U.S. Pat. No. 1,431,380, dated Oct. 10, 1922, with the exception of Badillo U.S. Pat. No. 4,493,278 and Grabowski U.S. Pat. No. 3,139,050, dated 6/1964.

Over ten years ago, Badillo, the inventor of the present invention, attempted to commercialize a replaceable tip hook, as shown in U.S. Pat. No. 4,493,278, dated Jan. 15, 1985. Although some promise was shown with that invention, the product ultimately was withdrawn from the market due to a malfunctioning mounting means and poor consistency of alignment between the parts that resulted in poor interchangeability of replaceable tips. The tolerances required to fit a replaceable tip upon the annular ting, as designed, made it impractical to meet a commercially viable price point. Badillo's attempt at allowing "play" or adjustability between the interchangeable parts, to meet these costs concerns, resulted in parts that could not withstand the extreme impact forces of the colliding needle into the replaceable tip free end. A needle strike against the replaceable tip would eventually move the tip relative to the annular frame and the needle eye out of alignment, and render the machine unuseable. The tip would have to be reset and proper timing reestablished to make the machine sew. The ensuing downtime to the operator caused by the constant need to re-time the machine and reset the tip caused the part to be withdrawn from the market.

Several patents have been granted in the art relating to replaceable tip hooks, but none known to the inventor herein has addressed the problem of consistency of fit and cost in the same manner as does the present invention. Indeed, much of the basic structure in Badillo's prior invention is incorporated into the present invention. In spite of having much of the same basic structure as applicant's prior invention in U.S. Pat. No. 4,493,278, the present invention differs in a novel and unobvious way. Applicant has now discovered a method in which a replaceable tip can be reliably manufactured in a cost effective way, and fit upon the annular frame without unwanted adjustability or "play".

Grabowsld, U.S. Pat. No. 3,139,050, departs from the vertical lamination approach of the prior art by having a solid, integrally formed loop seizing point with a downwardly extending lug, a curvature substantially corresponding to the annular frame, a tapered free end, and a rear end having a mounting hole for accepting a screw means. The lug nests within a notch formed upon the annular frame. However, his invention differs from the present invention in several important ways.

Grabowski has a first fixed protuberance that is located forward of the lug. Because his annular ring has no cutaway portion to facilitate thread exit off the loop seizing point, Grabowski utilizes the forward end of his loop seizing beak to form a mating cavity 61 to receive an axially fixed protuberance 54.

Grabowski has a second protuberance and mating cavity including a T-member 55 mating with a cavity 63. A pivoting movement is required to allow the loop seizing beak to be removed from the mating cavity. Grabowski's loop seizing beak can only nest within the mating cavity if a radially sliding motion is performed so that the lug can be pivoted therein. The complexity of the design of Grabowski's lug, T-member, and cavity may require very precise and expensive matching and tolerance control.

Dickson, U.S. Pat. No. 1,431,380, dated Oct. 10, 1992, shows a solid integrally formed loop seizing point with a downwardly extending lug to mount a notched section of the annular frame. However, with only one screw means to securely fasten the loop seizing point to the annular frame, the rotary loop taker of his invention would not appear to be able to endure the extreme impact required of the industrial sewing machines of today.

Despite great effort and volume of thought, to the knowledge of the inventor herein, a commercially viable replaceable tip rotary loop taker has yet to successfully appear on the market. The present invention teaches the elements of manufacturing a replaceable tip rotary loop taker with both the economical and functional requirements to fulfill this long and urgent need.

SUMMARY OF THE INVENTION

In one form, the rotary loop taker of this invention has an annular frame, a crosswise support member for rotatably supporting the frame, an integrally formed detachable loop seizing point mounted on the frame, and structure for detachably securing the loop seizing point to the frame. The frame has a cut away portion which is bounded by opposing end walls of the frame. The loop seizing point has a curvature corresponding to the annular frame. A downwardly extending lug extends into the cutaway portion and abuts, or is at all times spaced closely to, the end wall that is at the trailing end of the cutaway portion during rotation of the frame. A foot extends inwardly from the bottom of the downwardly extending lug into the crosswise support member to prevent the thread from becoming snagged or caught within the cracks between the loop seizing point and the annular frame.

As in conventional rotary loop takers, the middle and final portions of the raceway, which accept the radially extending bearing rib of a fixed position bobbin basket, are defined by the lower ledge on the inner wall of the annular frame and the upper ledge is defined by a gib which is detachably secured to the frame.

The detachable loop seizing point has an inner wall that carries the upper ledge of the raceway. The portion of the upper ledge not carried on the detachable loop seizing point is completed by the gib. The detachable loop seizing point may carry the lower ledge and the inner wall of the initial portion of the bobbin case raceway.

The structure for securing the loop seizing point to the annular frame includes a protuberance/projection in the form of a positioning and restraining post on the rear surface of the downwardly extending lug and a complementary cavity/receptacle on the frame end wall at the trailing end of the cut away portion. Conversely the protuberance/projection can be located on the end wall and the complementary cavity/receptacle on the rear surface of the lug. A releasable anchoring structure, such as a screw, secures the rear portion of the detachable loop seizing point to the annular frame.

A stabilizing projection/post is located circumferentially rearwardly of the aforementioned protuberance/projection in a complementary mating cavity/receptacle. The stabilizing post/projection projects either axially downward from the loop seizing point to penetrate the annular frame, or axially upwards from the annular frame to penetrate the loop seizing point. While it is preferred that the stabilizer/projection be a cylindrical stud, it need only engage a complementary mating surface that prevents radial or circumferential movement. A further example would be a downwardly extending wall and a complementary mating slot. Yet another embodiment could be a lug and a notch. The protuberance/projection is preferred to be surrounded in its entirety by the mating surface to prevent any radial or circumferential movement while engaged.

The stabilizer can be positioned either forward or behind the rearwardly disposed screw. The stabilizer is preferably positioned a sufficient distance behind the first circumferentially disposed protuberance/projection and complementary mating cavity/receptacle to allow an upward tilt until the mating surface is cleared. The loop seizing point is then circumferentially removed until the first protuberance/projection is cleared. It is preferred that the axial protuberance/projection be shorter than the circumferential protuberance/projection. This facilitates the tilting of the loop seizing point to clear its complementary mating surface. If the two protuberances/projections and their respective mating cavities/receptacles are too close in distance or aligned in a linear manner with respect to the frame, the loop seizing point could not tilt sufficiently upwards to vacate its mating cavity. It is thus preferred that the axial protuberance/projection and complementary mating cavity/receptacle be located about at least ¼ turn counter clockwise of the tapered free end of the loop seizing point. It is preferred that it be positioned at a ⅓ counterclockwise mm from the tapered free end of the loop seizing point.

The imprecise tolerances of the screw and screw holes required for releasably attaching the loop seizing point to, and detaching the loop seizing point from, the annular frame will not be depended upon, as in Badillo's prior patent, as the sole structure for preventing the loop seizing point from inadvertently moving upon the annular frame. The severe forces of vibration and severe needle impact will be absorbed by the stabilizer/projection, thereby maintaining the detachable loop seizing point in a fixed position. A further advantage is the ability to use the stabilizer/projection as a reference point to precisely align the raceway on the loop seizing point with the raceway on the annular frame. This will allow for greatly improved interchangeability of loop seizing points on varying annular frames. Another advantage is the reduction of cost that can be realized with this method of manufacturing the loop taker by using a second point of reference to allow for improved tolerance control.

These advantages are achieved by the applicant's novel improvement which is nowhere taught or shown in the prior art as known to applicant. The above detailed description has been given for the ease of understanding only. No unnecessary limitations should be understood therefrom, as modifications will be obvious to those skilled in the art.

DETAILED DESCRIPTION OF THE DRAWINGS

Figure 1:
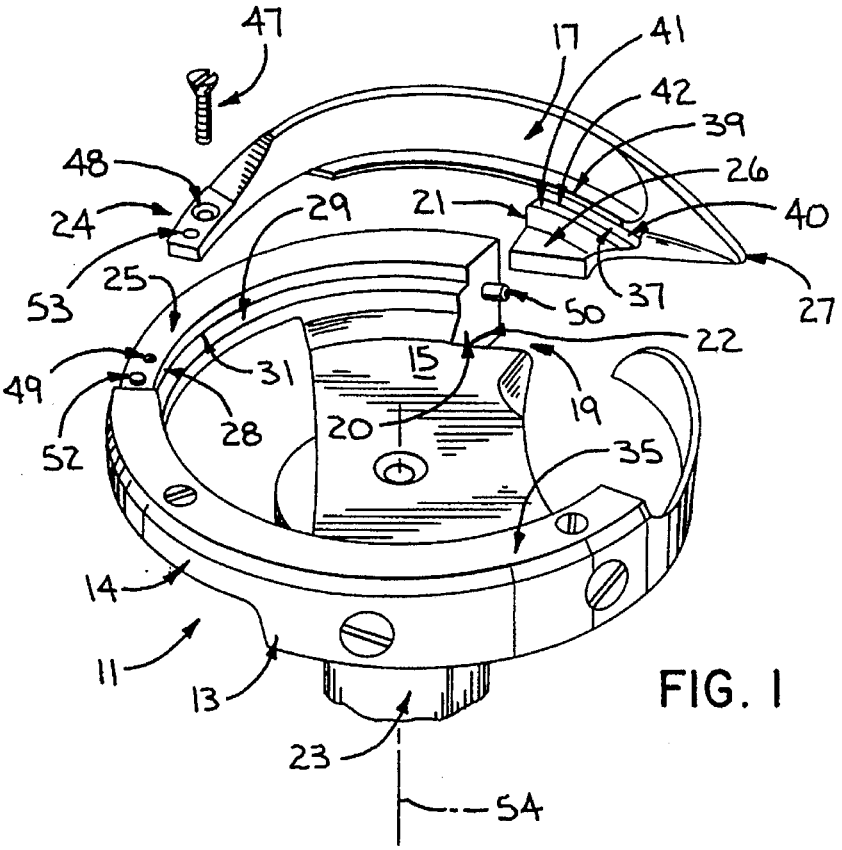
FIG. 1 is an exploded perspective view of a frame and loop seizing point with a preferred form of rotary loop taker, according to the present invention.

FIG. 1 shows a rotary loop taker 11 having a frame 13 with an annular portion 14 and a crosswise support member 15 for supporting the frame 13 for rotation, and an integrally formed, detachable loop seizing point 17. The frame 13 has a cutaway portion/gap 19 which is bounded by a circumferentially facing end wall 20 on the frame 13. A downwardly extending lug 21 extends into a notch 22 defined by the cutaway portion 19 during rotation of a shaft 23. A rear end portion 24 of the loop seizing point 17 rests upon an upwardly facing surface 25 of the annular frame 13. A foot 26 extends radially inwardly from the bottom of the downwardly extending lug 21 to the crosswise support member 15 to prevent thread from becoming snagged or caught within cracks between the loop seizing point 17 and the annular frame 13. A free end 27 of the loop seizing point 17 is located circumferentially forwardly of the downwardly extending lug 22 on the detachable loop seizing point 17. A middle and final portion of a raceway 28 accepts a radially extending beating rib of a fixed position bobbin basket (not shown) and is defined by a lower ledge 29 on an inner wall 31 of the annular frame 13 with a gib 35 defining the upper ledge of the raceway 28, which is detachably secured to the frame 13. The detachable loop seizing point 17 with an inner wall 37 carries an upper ledge 39 of an initial portion of a raceway 40. It is preferred that the detachable loop seizing point 17 carries the lower ledge 41 and inner wall 42 of the initial portion of the bobbin case raceway.

A screw means 47 secures the detachable loop seizing point 17 to the annular frame 13. The screw means 47 is received by a screw receiving hole 48 on the rear end portion 24 of the loop seizing point 17 and continues through to a screw receiving hole 49 located on the top facing surface 25 of the annular frame 13. A first fixed protuberance/projection 50 extends circumferentially from the end wall 20 into a first complementary mating cavity/receptacle 51 (See FIG. 2). A second fixed protuberance/projection 52, also referred to as a stabilizer, extends axially upwardly, substantially in the same line as the protuberance/projection 52, into a second complementary, mating cavity/receptacle 53. The projections 50, 52 are spaced in excess of 45° around the rotational axis 54 for the annular frame 13 and project in lines that are transverse to each other with the line of the protuberance/projection 52 being substantially parallel to the axis 54. Each protuberance/projection 50, 52 is in the form of a cylindrical post.

Figure 2:
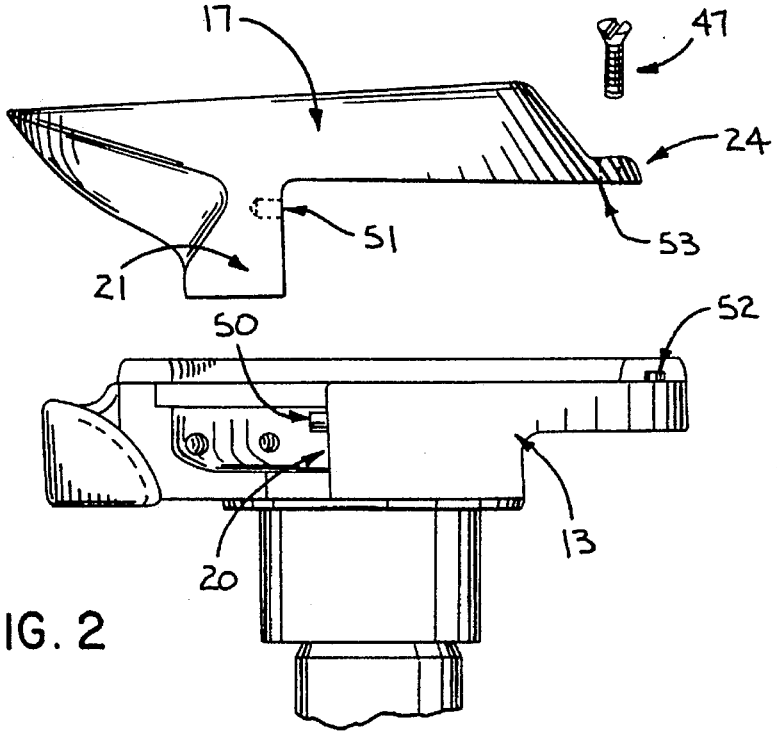
FIG. 2 is an exploded, side elevation view of the rotary loop taker of FIG. 1.

FIG. 2 shows a preferred means for securing and maintaining the loop seizing point 17 in an operative position on the annular frame 13 including the first protuberance/projection 50 fixed to and extending circumferentially from the end wall 20 into the first complementary cavity/receptacle 51 located on a rearwardly facing surface of the downwardly extending lug 21. The stabilizer/projection 52 is fixed to and extends axially upwardly from the annular frame 13 to penetrate the second complementary mating cavity/receptacle 53 located at the rear end portion 24 of the loop seizing point 17. The screw means 47 secures the rear end portion 24 of the loop seizing point 17 to the annular frame 13.

Figure 3:
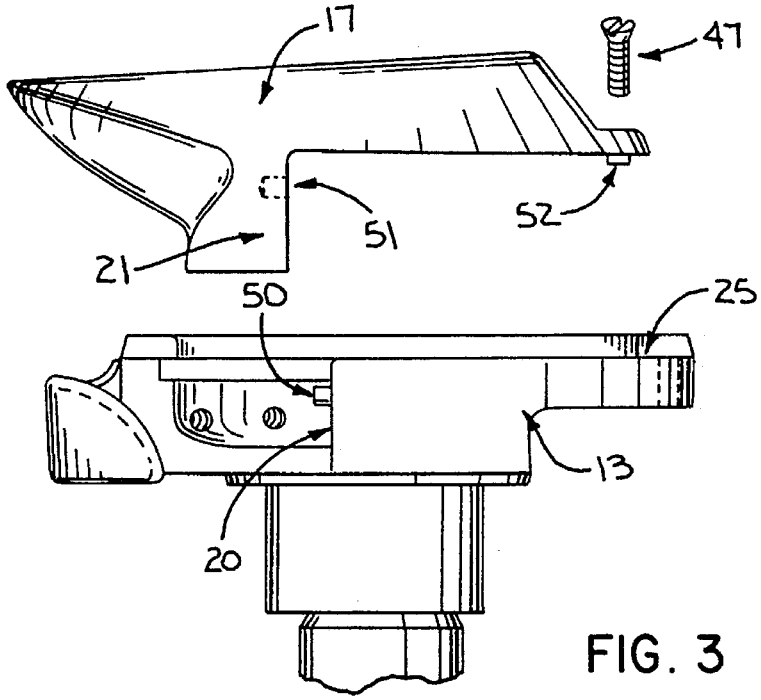
FIG. 3 is an exploded, side elevation view of a modified form of rotary loop taker, according to the present invention.

In another embodiment, shown in FIG. 3, the first protuberance/projection 50 is located fixedly on the end wall 20 and the first complementary receptacle/cavity 51 on the rearward facing surface of the downwardly extending lug 21. The stabilizer/projection 52 is fixed to and extends axially downwardly from the loop seizing point 17 to penetrate the top facing surface 25 of the annular frame 13. A screw means 47 secures the rear end portion 24 of the loop seizing point 17 to the annular frame 13.

Figure 4:
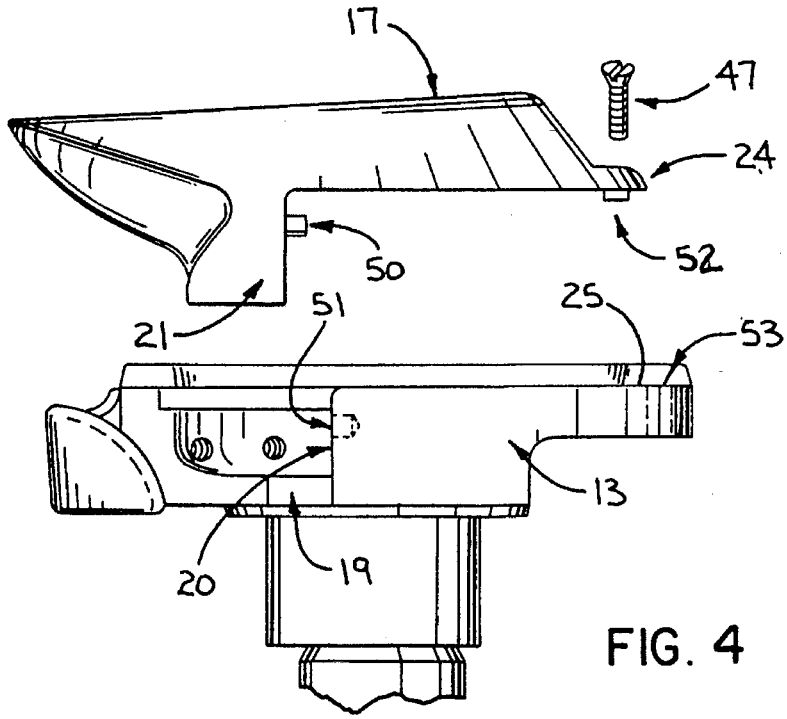
FIG. 4 is an exploded, side elevation view of another modified form of rotary loop taker, according to the present invention.

In yet another embodiment of the present invention, as shown in FIG. 4, the first protuberance/projection 50 is fixedly provided on the rear surface of the downwardly extending lug 21 and the first complementary receptacle/cavity 51 is provided on the frame end wall 20 at the trailing end of the cutaway portion 19. The stabilizer/projection 52 is seated circumferentially rearwardly of the first protuberance/projection 50 and extends axially downwardly to mate with the second complementary cavity/receptacle 53 on the top, upwardly facing surface 25 of the annular frame 13. A screw means 47 secures the rear end portion 24 of the loop seizing point 17 to the annular frame 13.

Figure 5:
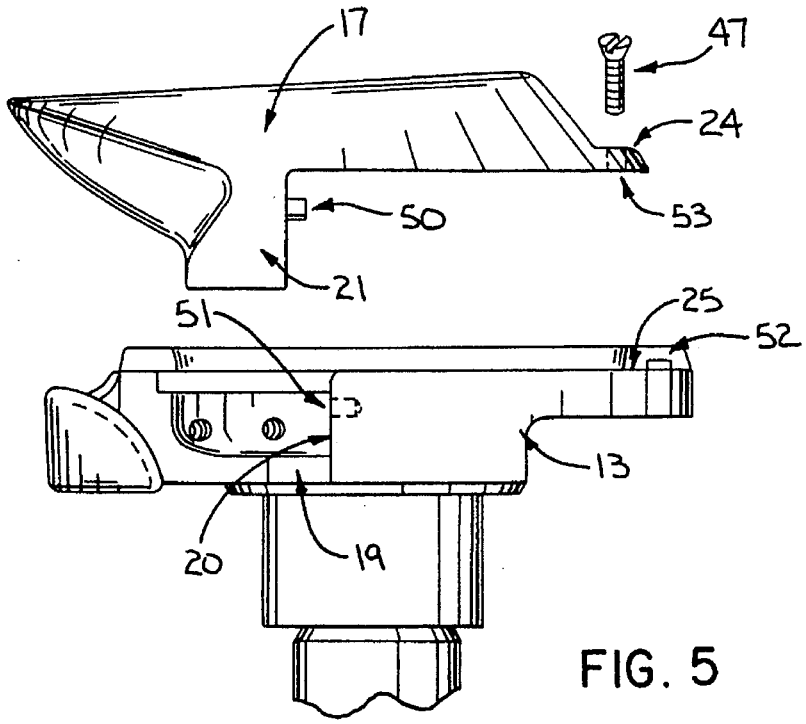
FIG. 5 is an exploded perspective view of still another form of rotary loop taker, according to the present invention.

FIG. 5 shows another embodiment of the present invention including the first protuberance/projection 50 fixed to and extending circumferentially from the rearwardly facing surface of the downward extending support 21 into the complementary mating cavity/receptacle 51 on the end wall 20. The stabilizer/projection 52 is fixed to and extends upwardly from the top, upwardly facing surface 25 of the annular frame 13 into the second complementary mating cavity/receptacle 53 located on the rear end portion 24 of the loop seizing point 17. The screw means 47 secures the rear end portion 24 of loop seizing point 17 to the annular frame 13.

Figure 6:
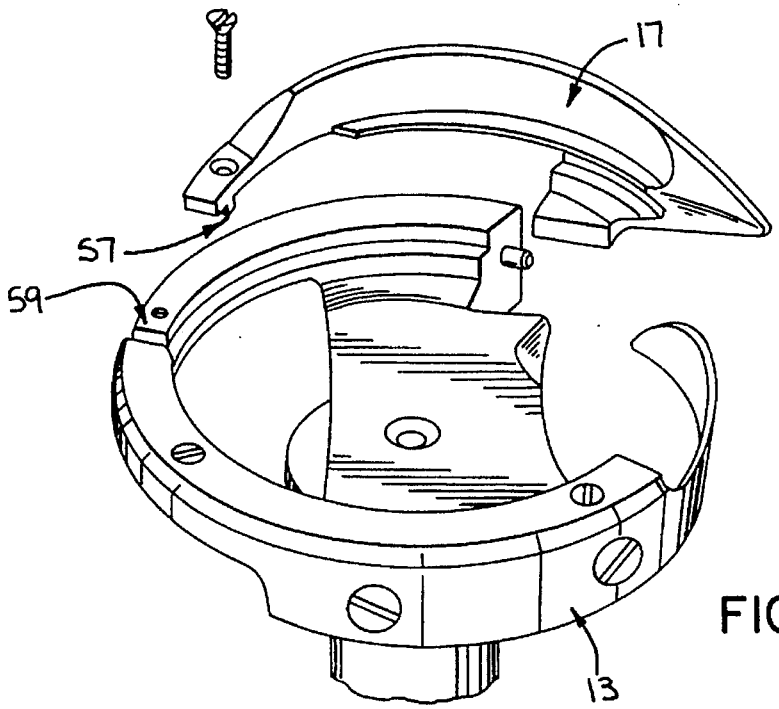
FIG. 6 is an exploded perspective view of yet another form of rotary loop taker, according to the present invention.

FIG. 6 shows yet another embodiment including a downwardly extending wall/projection 57 and a complementary mating slot/receptacle 59 on the frame 13.

Figure 7:
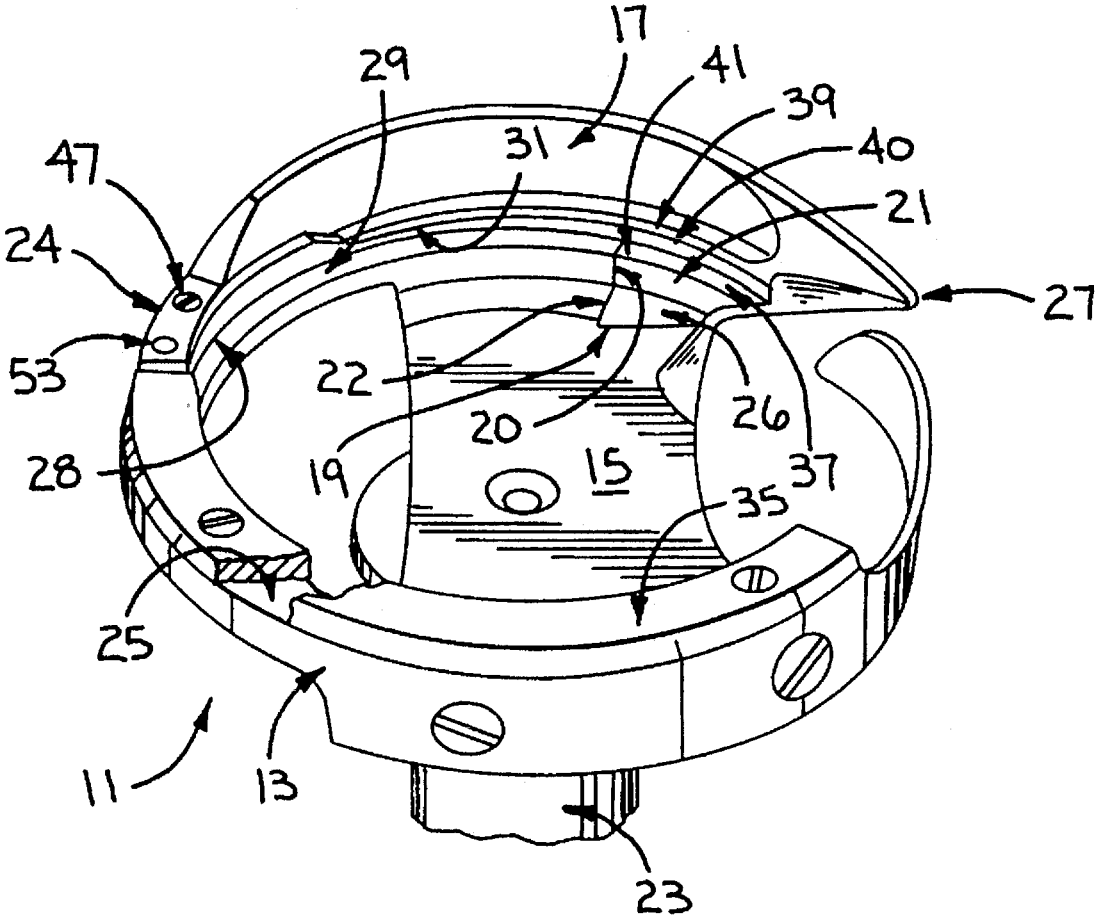
FIG. 7 is a perspective view of the rotary loop taker of FIG. 1 in an assembled state.

FIG. 7 shows the preferred mode of this invention in its operational view. The detachable loop seizing point 17 is mounted upon the annular frame 13. The free end 27 rotates in a clockwise rotation to pick a needle thread loop off a needle (not shown). The downwardly extending lug 21 nests within the notch 22 in a close but not necessarily abutting fit. The stabilizer 52 (not shown in this Figure) extends axially into the second complementary mating cavity/receptacle 53. When a needle impacts the free end portion 27, the stabilizer 52 (not shown in this drawing) absorbs shock and prevents vibration. The detachable loop seizing point 17 is thus stabilized.

FIGS. 1, 3, 4, 5, and 6 show that stabilizer/projection 52 is positioned a sufficient distance away from the first protuberance/projection 50 and first complementary mating cavity/receptacle 51 to allow an upward tilt to vacate the second complementary cavity/receptacle 53. The loop seizing point 17 is then circumferentially moved until the first protuberance/projection 50 is cleared. To facilitate loop seizing detachment, the second axial protuberance/projection 51 is shorter than first protuberance/projection 50.

The foregoing disclosure of specific embodiments is intended to be illustrative of the broad concepts comprehended by the invention.

I claim:

1. A rotary loop taker comprising:

a frame having a rotational axis and including an annular part and a support extending radially from the rotational axis to the annular frame part;

a loop seizing point; and first means cooperating between the frame and loop seizing point for removably maintaining the loop seizing point in an operative position on the frame, said first cooperating means comprising a) a first fixed projection on one of the loop seizing point and annular part of the frame, b) a first receptacle for the first projection on the other of the loop seizing point and annular part of the frame, c) a second fixed projection on one of the loop seizing point and annular part of the frame, and d) a second receptacle for the second projection on one of the loop seizing point and annular part of the frame, said first projection being spaced from the second projection at least 45° around the rotational axis of the frame.

2. The rotary loop taker according to claim 1 wherein the first cooperating means comprises means for releasably maintaining the loop seizing point on the frame so that the loop seizing point and frame can be fully separated, each from the other, the first receptacle is substantially fully surrounded by one of the loop seizing point and annular part of the frame, and the second receptacle is substantially fully surrounded by one of the loop seizing point and annular part of the frame.

3. The rotary loop taker according to claim 1 wherein the first projection projects from one of the loop seizing point and annular part of the frame parallel to a first line and the second projection projects from one of the loop seizing point and annular part of the frame parallel to a second line, said first and second lines being transverse to each other.

4. The rotary loop taker according to claim 1 wherein the first cooperating means comprises screw means that is extendable into both the loop seizing point and the frame.

5. The rotary loop taker according to claim 4 wherein the screw means comprises a threaded element with a central axis, the first projection projects from one of the loop seizing part and annular part of the frame parallel to a first line and the central axis of the threaded element is substantially parallel to the first line.

6. The rotary loop taker according to claim 5 wherein the threaded element is closer to the first projection than it is to the second projection.

7. The rotary loop taker according to claim 1 wherein the annular frame part has a gap that is bounded by a circumferentially facing surface and one of the first and second projections one of a) projects through and b) projects from the circumferentially facing surface on the annular frame part.

8. The rotary loop taker according to claim 7 wherein one of the first and second projections projects in a direction substantially parallel to the rotational axis of the frame.

9. The rotary loop taker according to claim 1 wherein the rotary loop taker has a raceway defined cooperatively by an arcuate surface facing axially with respect to the rotational axis and an arcuate surface facing radially with respect to the rotational axis and the raceway is defined partially by the frame and partially by the loop seizing point.

10. A rotary loop taker comprising:

a frame having a rotational axis;

a loop seizing point; and first means cooperating between the frame and loop seizing point for removably maintaining the loop seizing point in an operative position on the frame so that the loop seizing point and frame can be fully separated, each from the other, said first cooperating means comprising a) a first fixed projection on one of the loop seizing point and frame, b) a first receptacle for the first projection on the other of the loop seizing point and frame, c) a second fixed projection on one of the loop seizing point and frame, and d) a second receptacle for the second projection on one of the loop seizing point and frame, wherein the first projection projects parallel to a first line and the second projection projects in a second line with the loop seizing point in the operative position, said first and second lines being transverse to each other.

11. The rotary loop taker according to claim 10 wherein the frame has an annular part and a support extending radially from the rotational axis of the frame to the annular frame part, there is a gap in the annular frame part that is bounded by a circumferentially facing surface and one of the first and second projections one of a) projects through and b) projects from the circumferentially facing surface on the annular frame part.

12. The rotary loop taker according to claim 10 wherein the frame has an annular part and a support extending radially from the rotational axis to the annular frame part, the loop seizing point has a depending lug and the lug nests against the frame support.

13. The rotary loop taker according to claim 10 wherein the first cooperating means comprises screw means that is extendable into the loop seizing point and the frame.

14. The rotary loop taker according to claim 13 wherein the screw means comprises a threaded element with a central axis and the central axis is substantially parallel to the first line.

15. The rotary loop taker according to claim 14 wherein the central axis of the threaded element is substantially parallel to the rotational axis of the frame.

16. The rotary loop taker according to claim 15 wherein the threaded element is closer to the first projection than it is to the second projection.

17. The rotary loop taker according to claim 10 wherein the first receptacle is substantially fully surrounded by one of the loop seizing point and frame and the second receptacle is substantially fully surrounded by one of the loop seizing point and frame.

18. A rotary loop taker comprising:

a frame having a rotational axis and including an annular part and a support extending radially from the rotational axis to the annular frame part, said annular frame part having a gap that is bounded by a circumferentially facing surface;

a loop seizing point; and first means cooperating between the frame and loop seizing point for maintaining the loop seizing point in an operative position on the frame, said first cooperating means comprising a) a first projection on one of the loop seizing point and the circumferentially facing surface on the frame, b) a first receptacle for the first projection on the other of the loop seizing point and the circumferentially facing surface on the frame, and c) second means cooperating between the loop seizing point and frame at a first location spaced from the circumferentially facing surface for limiting relative movement between the loop seizing point and frame at the first location, wherein the second cooperating means comprises a second fixed projection on one of the loop seizing point and frame and a second receptacle for the second projection on the other of the loop seizing point and frame.

19. The rotary loop taker according to claim 18 wherein the first cooperating means comprises means for removably maintaining the loop seizing point on the frame so that the loop seizing point and frame can be fully separated, each from the other.

20. The rotary loop taker according to claim 18 wherein the loop seizing point has a depending lug which nests against the frame support with the loop seizing point in the operative position on the frame.

21. The rotary loop taker according to claim 18 wherein the first and second projections comprise first and second posts with first and second central axes, respectively, said first and second central axes extending transversely to each other.

22. The rotary loop taker according to claim 18 wherein the second means comprises a screw means separate from the second projection extending into each of the frame and loop seizing part.

23. The rotary loop taker according to claim 18 wherein the first receptacle is substantially fully surrounded by one of the loop seizing part and frame and the second receptacle is substantially fully surrounded by one of the loop seizing part and frame.

* * * * *